US008943929B2

(12) United States Patent
Ou et al.

(10) Patent No.: US 8,943,929 B2
(45) Date of Patent: Feb. 3, 2015

(54) TORSION ADJUSTMENT STRUCTURE OF RATCHET WRENCH

(76) Inventors: Yu-Hua Ou, Taichung (TW); Chih-Chi Chen, Taichung (TW)

( * ) Notice: Subject to any disclaimer, the term of this patent is extended or adjusted under 35 U.S.C. 154(b) by 273 days.

(21) Appl. No.: 13/585,378

(22) Filed: Aug. 14, 2012

(65) Prior Publication Data

US 2014/0047955 A1 Feb. 20, 2014

(51) Int. Cl.
*B25B 13/46* (2006.01)

(52) U.S. Cl.
USPC ..... 81/60

(58) Field of Classification Search
USPC ..... 81/60, 58, 58.1, 58.4, 177.8, 177.9
See application file for complete search history.

(56) References Cited

U.S. PATENT DOCUMENTS

| | | | | |
|---|---|---|---|---|
| 302,166 | A * | 7/1884 | Sexton | 81/60 |
| 3,009,372 | A * | 11/1961 | Kostka | 81/58.4 |
| 4,622,870 | A * | 11/1986 | Shirley | 81/60 |
| 6,789,449 | B2 * | 9/2004 | Liu | 81/58.1 |
| 8,596,169 | B2 * | 12/2013 | Wang | 81/60 |

* cited by examiner

*Primary Examiner* — Hadi Shakeri
(74) *Attorney, Agent, or Firm* — Muncy, Geissler, Olds & Lowe, P.C.

(57) ABSTRACT

A ratchet wrench includes a head and a handle. The head is assembled with a switch member and an active mechanism which provides a ratchet function. The switch member is switched to selectively engage the active mechanism, so that the active mechanism may be fixed or be rotatable to achieve the ratchet function. Therefore, the wrench is provided with the function of ratchet which makes the wrench easy to use and with the function of fixing which makes the structure strength of the wrench strengthened. Conveniency of using wrench is improved.

5 Claims, 10 Drawing Sheets

TORSION ADJUSTMENT STRUCTURE OF RATCHET WRENCH

BACKGROUND OF THE INVENTION

1. Field of the Invention

The present invention relates to a ratchet wrench, in particular to an adjustment structure for controlling rotation condition of ratchet mechanism of the ratchet wrench. The ratchet mechanism can be stuck or released for controlling the rotation condition.

2. Description of the Prior Art

There are two species of wrenches which are market available. One is provided with ratchet mechanism. In manipulation, user can pull the ratchet wrench back and forth for rotating threaded member and tightening or releasing the threaded member. Though the ratchet wrench is easy to use, however, the affordable maximum torsional force of the wrench is diminished. The other wrench is provided without ratchet mechanism. This kind of wrench is usually provided in single piece, so that structure strength of the wrench is strengthened. However, without ratchet mechanism, the wrench is not easy to use.

Each wrench mentioned above has specialized advantages. Therefore, user can choose the corresponding wrench for a particular work condition. However, for managing unpredictable situations, user has to prepare both of the wrenches.

The present invention is, therefore, arisen to obviate or at least mitigate the above mentioned disadvantages.

SUMMARY OF THE INVENTION

The main object of the present invention is to provide an adjustment mechanism to a wrench. The adjustment mechanism is provided with a slidable piece for switching. The slidable piece and the ratchet mechanism of the wrench are provided with toothed portion. Thus, user can switch the slidable piece, determining engaging the ratchet mechanism of the wrench or not.

A second object of the present invention is to provide a wrench which has both fixed and ratchet function. Thus, requirements of variable work conditions are fulfilled by the single wrench.

A third object of the present invention is to provide a wrench which can be switched and rotated with smooth motion. Such desirable manipulation condition can be provided by finely toothed components.

To achieve the above and other objects, a torsion adjustment structure of a ratchet wrench of the present invention includes a head, a handle, an active mechanism, and a switch member.

The head is connected to the handle at a rear end of the head. The head is formed with a receiving groove and a toothed groove at a front end of the head. The receiving groove is larger than the toothed groove. An elongated groove is defined at a rear end of the receiving groove. A depth of the elongated groove is equal to a depth of the receiving groove. The elongated groove is connected to the receiving groove. The elongated groove is formed with a positioning groove. An elastic member and an abutting member are disposed in the positioning groove.

The active mechanism is disposed in the head. The active mechanism has a toothed engagement portion and a ratchet portion which are disposed in the receiving groove and the toothed groove respectively. The engagement portion has annularly arranged teeth.

The switch member is disposed in the elongated groove of the head. The switch member is formed with a protruded switch portion thereon. The switch member is formed with a front groove and a rear groove at a bottom end thereof The front groove and the rear groove are located corresponding to the abutting member which is disposed in the positioning groove. The switch member is formed with a tooth portion corresponding to the engagement portion at a front end thereof A cover is disposed above a top end of the switch member. The cover is secured to the head. The cover is formed with a bore which is provided for the switch portion to penetrate therethrough.

Whereas the switch member is disposed at a front end of the elongated groove, the tooth portion of the switch member mates and engages the engagement portion of the active mechanism so as to restrict rotation of the active mechanism.

Whereas the switch member is disposed at a rear end of the elongated groove, the tooth portion of the switch member is left apart from the engagement portion of the active mechanism, so that the active mechanism is able to rotate with the ratchet portion.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
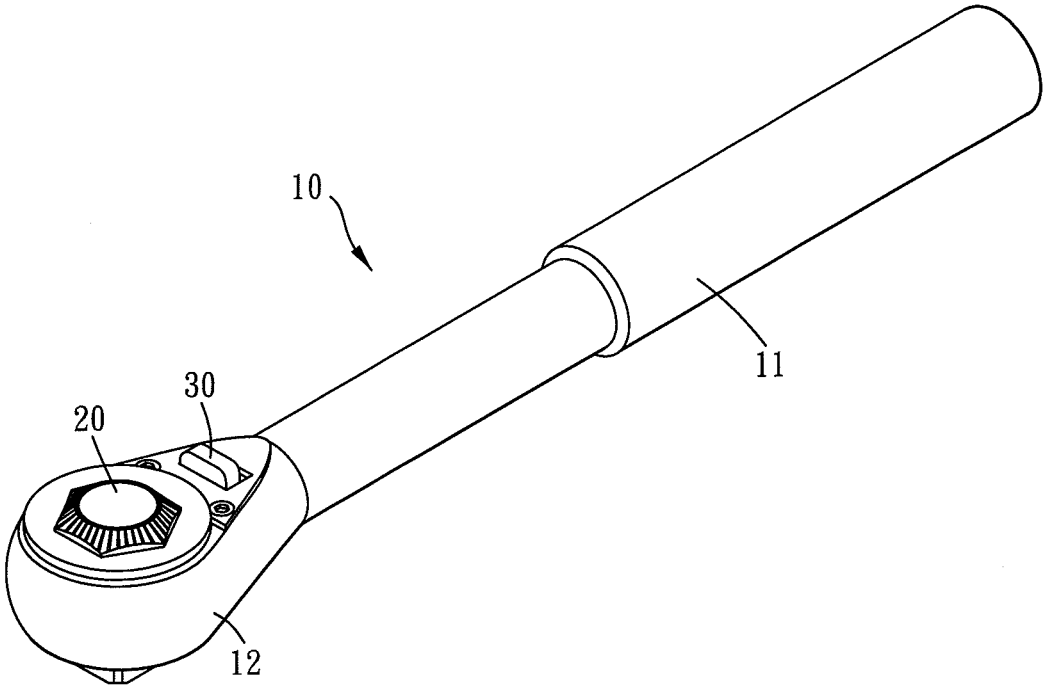
FIG. 1 is a stereogram showing a first embodiment of the present invention.
Figure 2:
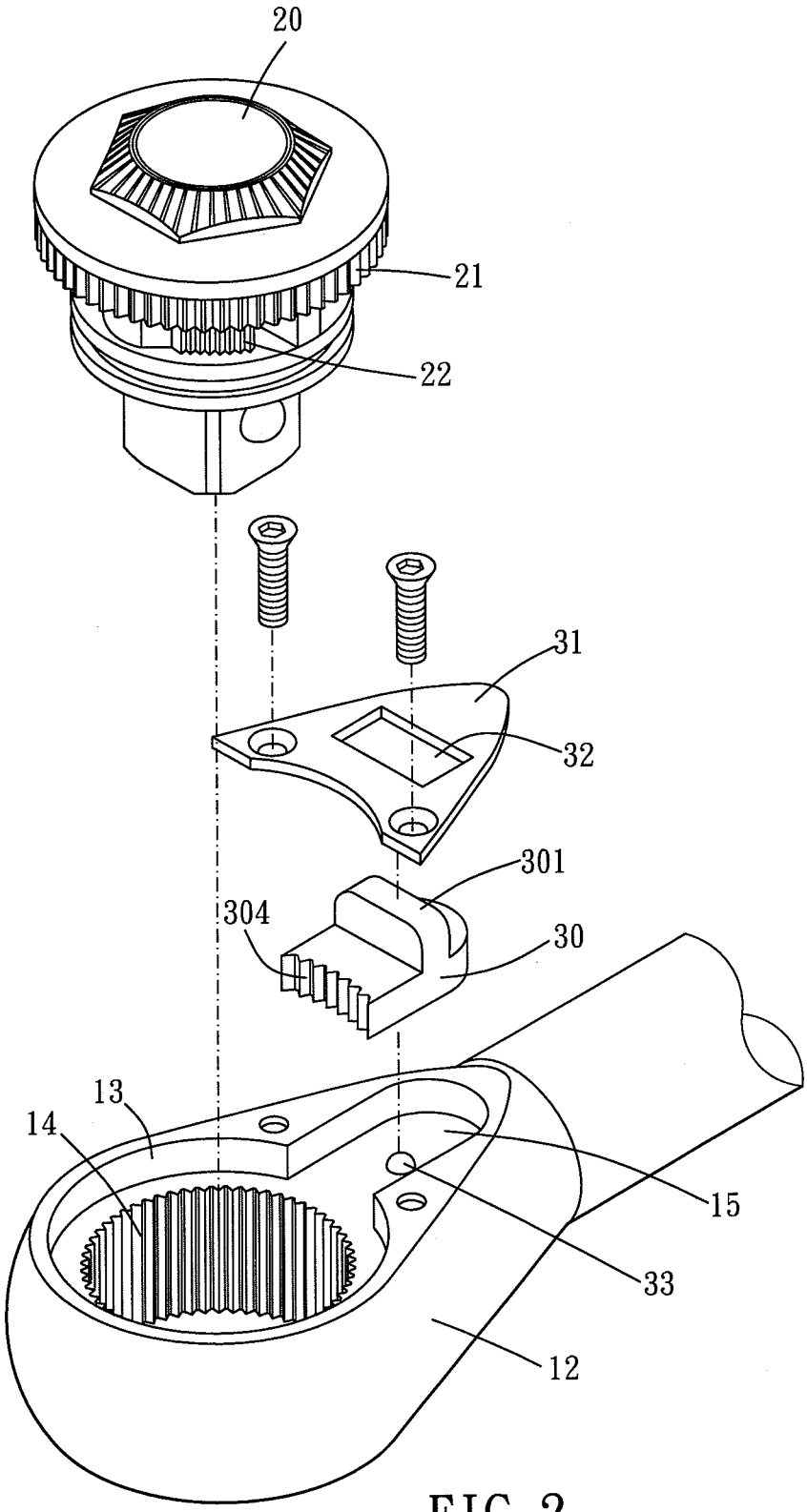
FIG. 2 is a breakdown drawing showing a first embodiment of the present invention.
Figure 3:
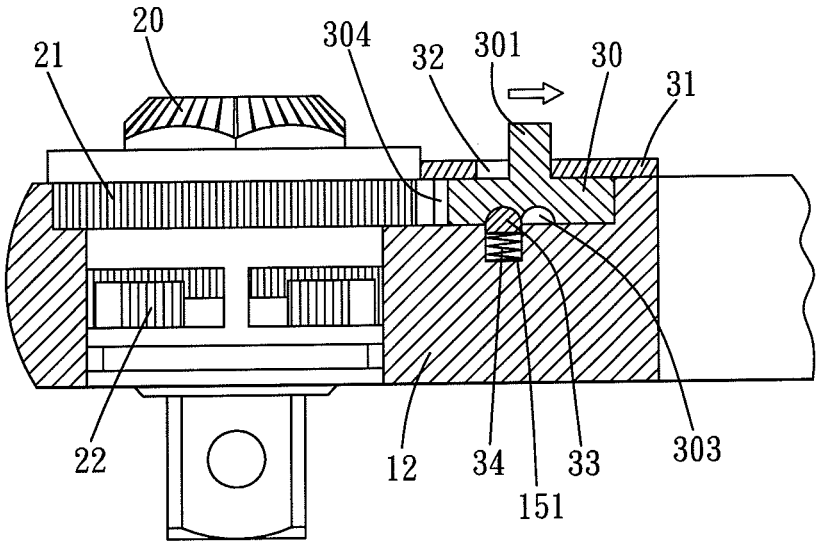
FIG. 3 is a profile showing disengagement condition of a switch member and an active mechanism of a first embodiment of the present invention.

Please refer to FIG. 1 to FIG. 3 for a first embodiment of the present invention. The ratchet wrench 10 of the present embodiment mainly includes a handle 11 and a head 12. The head 12 is formed with a receiving groove 13 and a toothed groove 14 at a front end thereof. The receiving groove 13 is larger than the toothed groove 14. The receiving groove 13 and the toothed groove 14 are adapted for an engagement portion 21 and a ratchet portion 22 of an active mechanism 20 to be disposed therein respectively. An elongated groove 15 is defined at a rear end of the receiving groove 13. The elongated groove 15 is connected to the receiving groove 13 and has a depth equal to a depth of the receiving groove 13. The elongated groove 15 is formed with a positioning groove 151. An elastic member 34 and an abutting member 33 are disposed in the positioning groove 151. A switch member 30 is disposed in the elongated groove 15. The switch member 30 is formed with a protruded switch portion 301 thereon. The switch member 30 is formed with a front groove 302 and a rear groove 303 at a bottom end thereof. The locations of the front groove 302 and the rear groove 303 are arranged to correspond to the abutting member 33. The switch member 30 is formed with a tooth portion 304 corresponding to the engagement portion 21 of the active mechanism 20 at a front end thereof. A cover 31 is disposed above a top end of the switch member 30. The cover 31 is secured to the head 12. The cover 31 is formed with a bore 32 which is provided for the switch portion 301 of the switch member 30 to penetrate therethrough.

Figure 4:
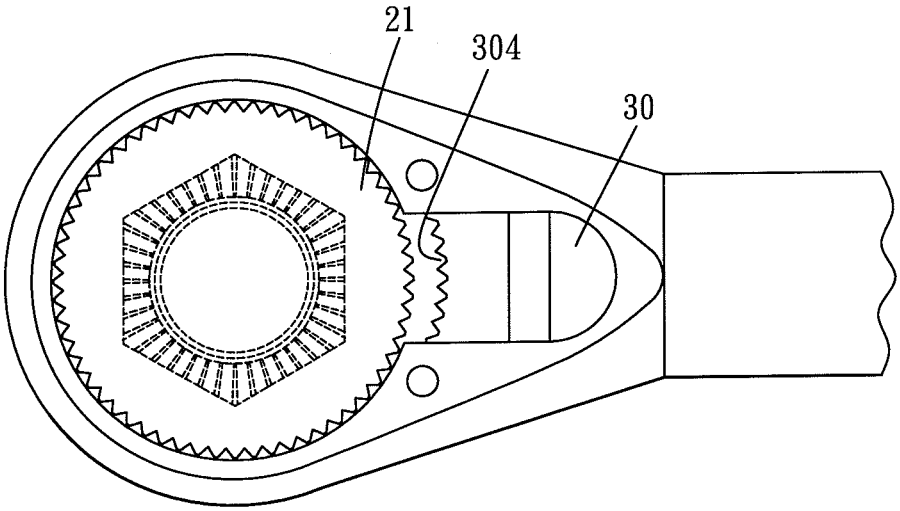
FIG. 4 is a schematic drawing showing disengagement condition of a switch member and an active mechanism of a first embodiment of the present invention.

Please refer to FIG. 3 and FIG. 4. When the switch member 30 is located or positioned at a rear end of the elongated groove 15, the abutting member 33 presses against the front groove 302 of the switch member 30. Thus, the switch member 30 is positioned at the given position. The tooth portion 304 of the switch member 30 does not engage the engagement portion 21 of the active mechanism 20. Therefore, the active mechanism is able to rotate clockwise or counterclockwise with ratchet mechanism.

Figure 5:
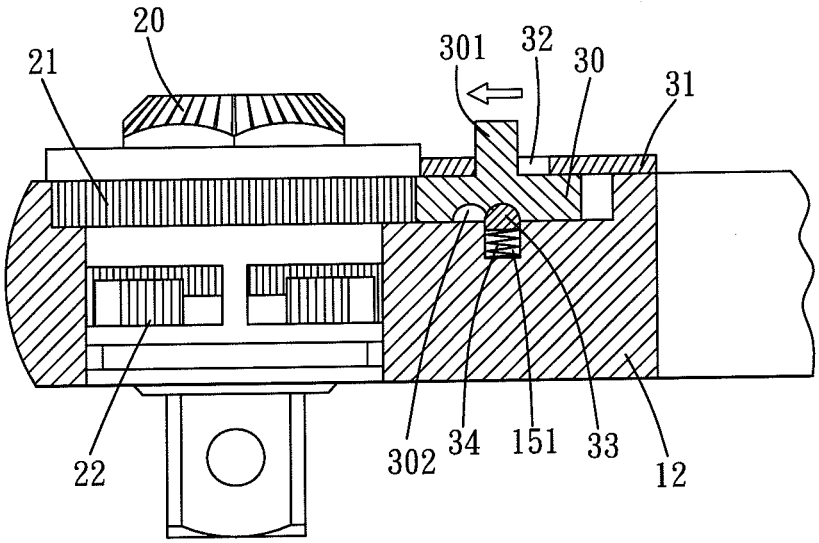
FIG. 5 is a profile showing engagement condition of a switch member and an active mechanism of a first embodiment of the present invention.
Figure 6:
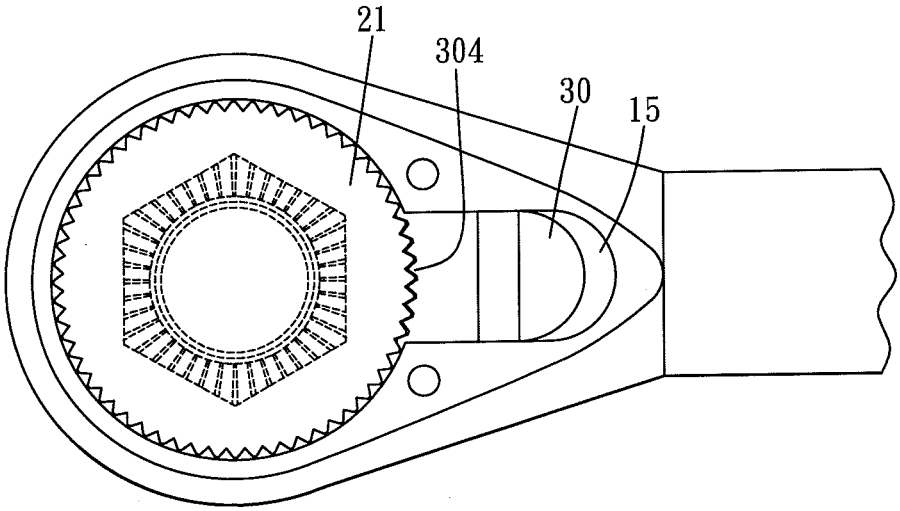
FIG. 6 is a schematic drawing showing engagement condition of a switch member and an active mechanism of a first embodiment of the present invention.

Please refer to FIG. 5 and FIG. 6. When the switch member 30 is located or positioned at a front end of the elongated groove 15, the abutting member 33 presses against the rear groove 303 of the switch member 30. Thus, the switch member 30 is positioned at another given position. The tooth portion 304 of the switch member 30 mates and engages the engagement portion 21 of the active mechanism 20. Rotation of the active mechanism 20 is restricted. Therefore, the active mechanism is fixed and unable to rotate.

Figure 7:
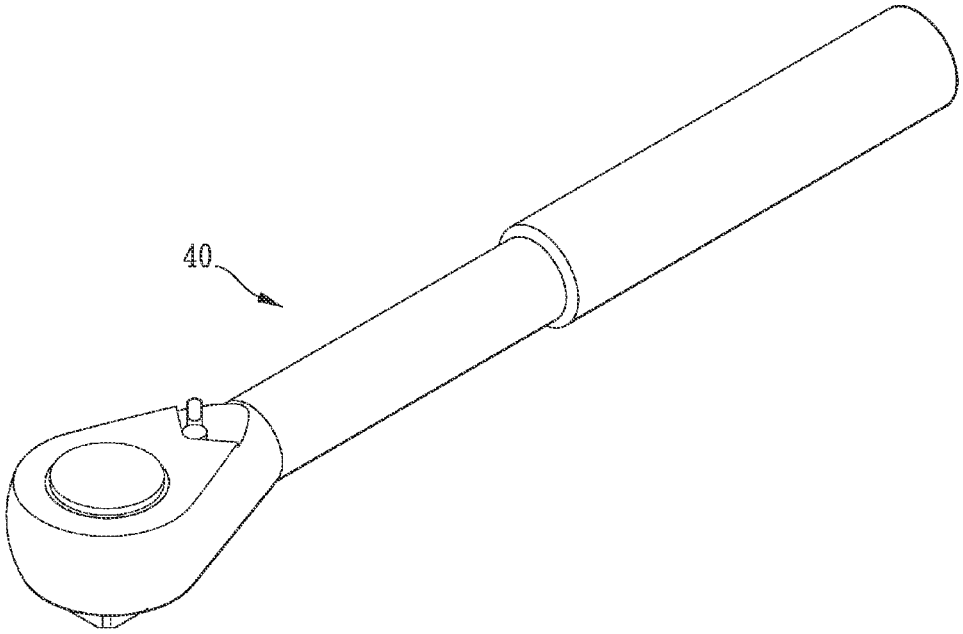
FIG. 7 (Prior Art)
FIG. 7 is a stereogram showing a conventional ratchet wrench.
Figure 8:
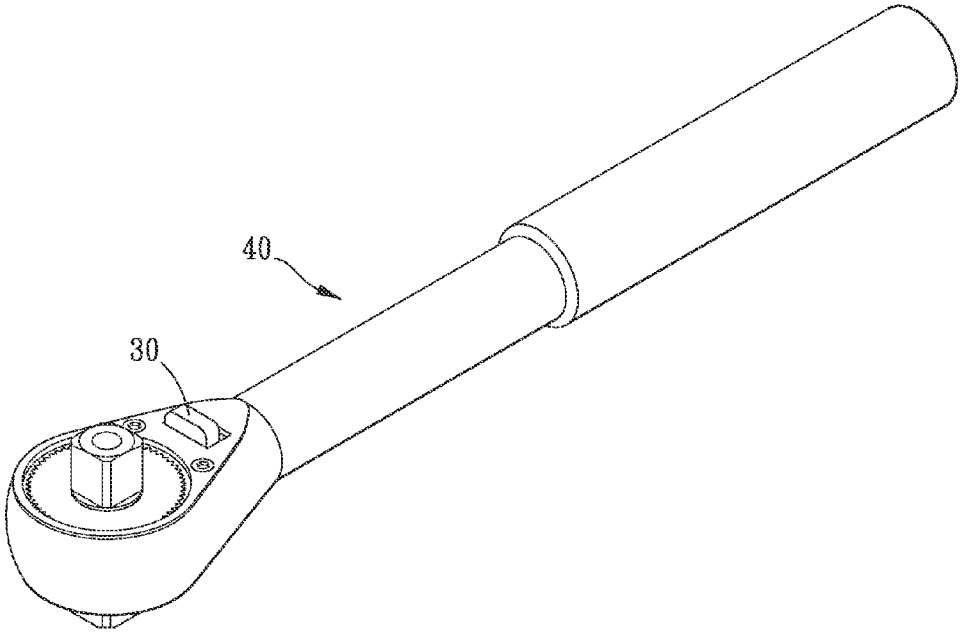
FIG. 8 is a stereogram showing a second embodiment of the present invention.
Figure 9:
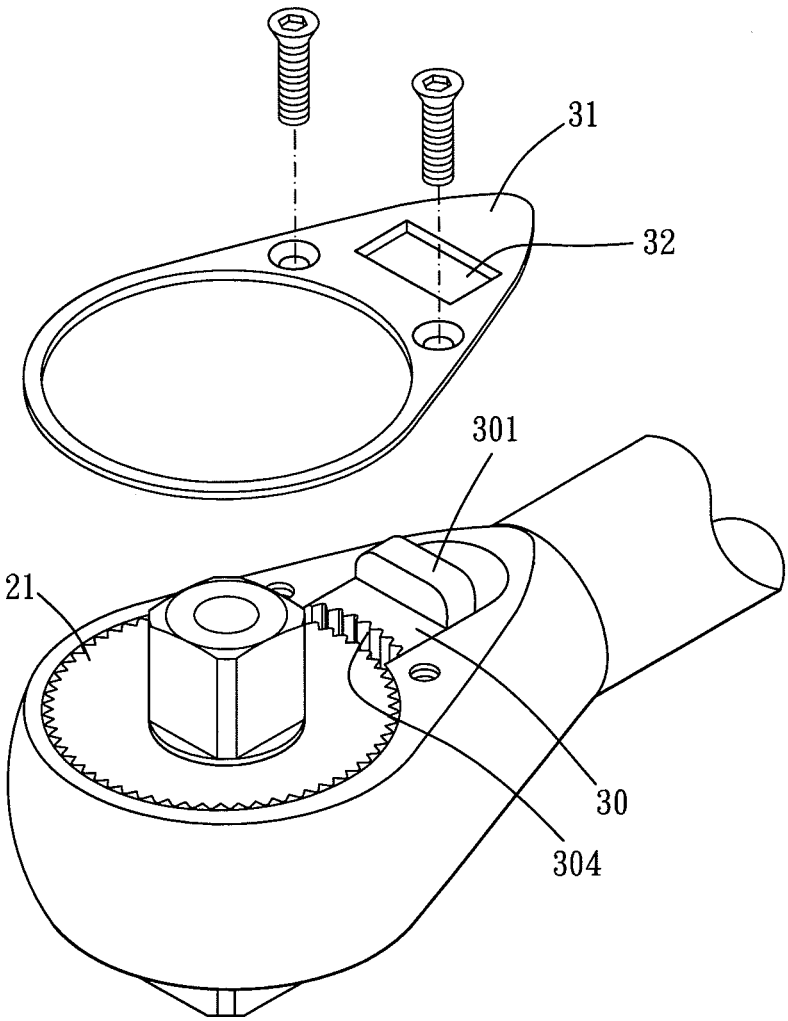
FIG. 9 is a breakdown drawing showing disengagement condition of a switch member and an active mechanism of a second embodiment of the present invention.
Figure 10:
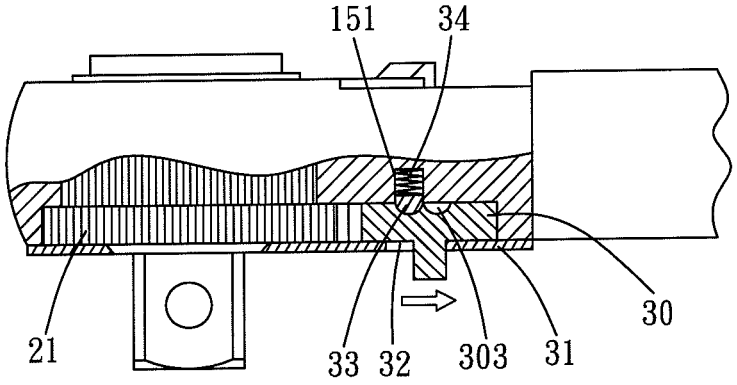
FIG. 10 is a profile showing disengagement condition of a switch member and an active mechanism of a second embodiment of the present invention.
Figure 12:
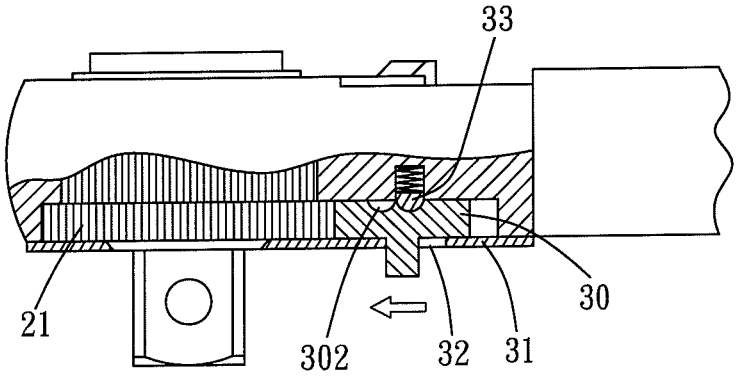
FIG. 12 is a profile showing engagement condition of a switch member and an active mechanism of a second embodiment of the present invention.
Figure 11:
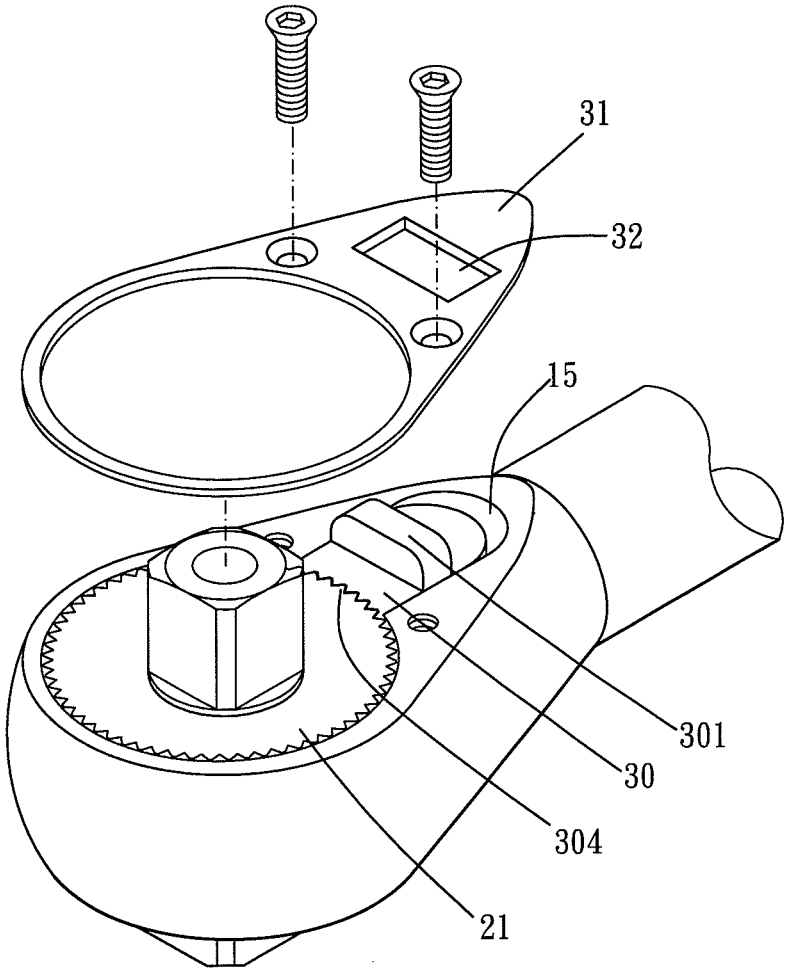
FIG. 11 is a breakdown drawing showing engagement condition of a switch member and an active mechanism of a second embodiment of the present invention.

Please refer to FIG. 1 and FIG. 7. In comparison with a conventional ratchet wrench, as shown in FIG. 7, the adjustable switch member 30 of the ratchet wrench of the first embodiment of the present invention is used for controlling fixing or engaging the active mechanism or not. The user approachable switch of a conventional ratchet wrench is used for controlling rotating direction of the ratchet mechanism.

Please refer to FIG. 8 to FIG. 12. In a second embodiment of the present invention, in comparison with the first embodiment described above, the switch member 30 may be disposed adjacent to a bottom end of the head. It should be noted that the shown active mechanism is turned over in the drawings, and the drawn ratchet wrench is placed upside down. Since the switch member 30 is disposed adjacent to the bottom end, the receiving groove, the ratchet portion, the elongated groove, and the related components should be disposed adjacent to the bottom end, also. Thus, the ratchet wrench still functions as the ratchet wrench of the described first embodiment do.

Figure 13:
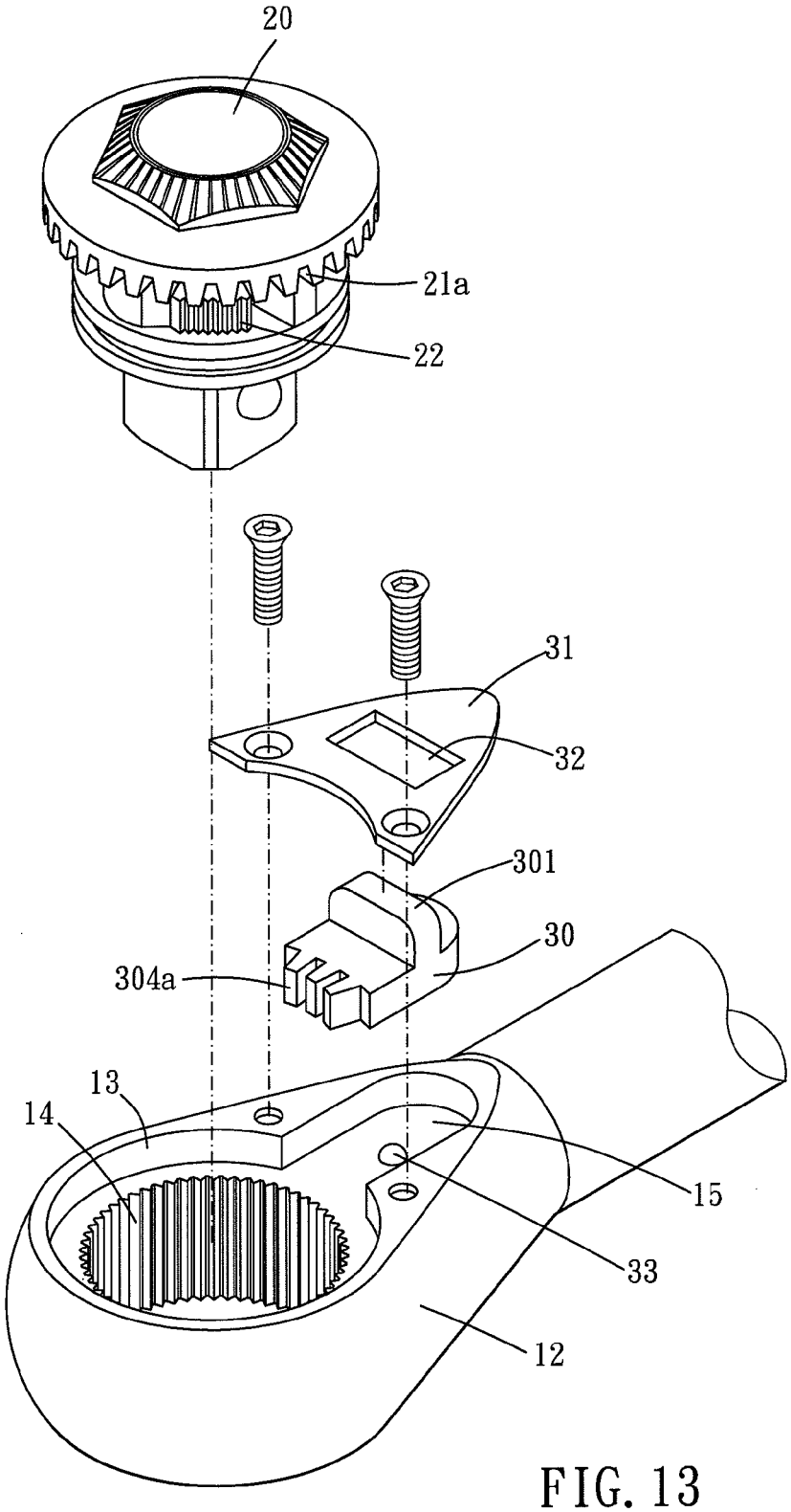
FIG. 13 is a breakdown drawing showing a third embodiment of the present invention.
Figure 14:
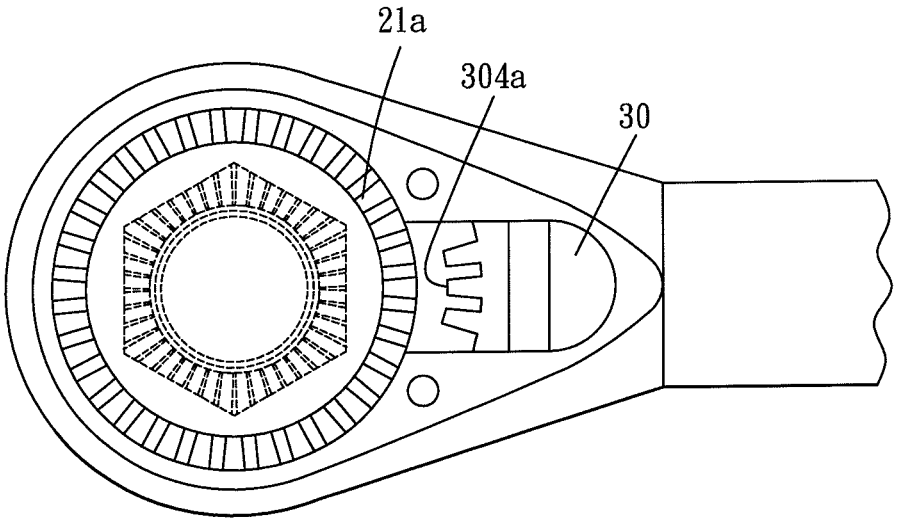
FIG. 14 is a schematic drawing showing a third embodiment of the present invention.

Please refer to FIG. 13 and FIG. 14. In a third embodiment of the present invention, structure or the ratchet wrench is roughly equal to the ratchet wrench of the first embodiment. To comparison to the first embodiment, the engagement portion 21*a* of the active mechanism 20 and the tooth portion 304*a* of the switch member 30 are formed in different appearances. The engagement portion 21*a* is formed as a spline which is composed of several trapezoid teeth. The tooth portion 304*a* is composed of three or several teeth. In other possible embodiments of the present invention, the engagement portion 21*a* and the tooth portion 304*a* may be formed in other suitable appearances which allow the tooth portion mates and engages the engagement portion. Accordingly, the engagement portion 21*a* and the tooth portion 304*a* of the third embodiment may be suitable for the second embodiment, also.

Accordingly, the ratchet wrench of the present invention is provided with the switch member and the active mechanism which has an engagement portion. User can switch the ratchet wrench quickly and easily between a rotatable condition and a fixed condition. When the ratchet wrench is switched to the fixed condition, the switch member and the engagement portion bear the internal stress of the wrench. Thus, fine ratchet mechanism may escape from the internal stress when the ratchet wrench is fixed. Therefore, function of ratchet mechanism is retained, and structure strength of the ratchet wrench is strengthened. Conveniency of using wrench is improved.

What is claimed is:

1. A torsion adjustment structure of a ratchet wrench, mainly comprising:

a head, being connected to a handle at a rear end of the head, the head being formed with a receiving groove and a toothed groove at a front end of the head, the receiving groove being larger than the toothed groove, an elongated groove being defined at a rear end of the receiving groove, a depth of the elongated groove being equal to a depth of the receiving groove, the elongated groove being connected to the receiving groove, the elongated groove being formed with a positioning groove, an elastic member and an abutting member being disposed in the positioning groove;

an active mechanism, being disposed in the head, the active mechanism having a toothed engagement portion and a ratchet portion which are disposed in the receiving groove and the toothed groove respectively, the engagement portion having annularly arranged teeth;

a switch member, being disposed in the elongated groove of the head, the switch member being formed with a protruded switch portion thereon, the switch member being formed with a front groove and a rear groove at a bottom end thereof, the front groove and the rear groove being located corresponding to the abutting member which is disposed in the positioning groove, the switch member being formed with a tooth portion corresponding to the engagement portion at a front end thereof, a cover being disposed above a top end of the switch member, the cover being secured to the head, the cover being formed with a bore which is provided for the protruded switch portion to penetrate therethrough;

whereas the switch member is disposed at a front end of the elongated groove, the tooth portion of the switch member mates and engages the engagement portion of the active mechanism so as to restrict rotation of the active mechanism;

whereas the switch member is disposed at a rear end of the elongated groove, the tooth portion of the switch member is left apart from the engagement portion of the active mechanism, so that the active mechanism is able to rotate with the ratchet portion.

2. The torsion adjustment structure of claim 1, wherein the abutting member presses against the rear groove of the switch member when the switch member is located at the front end of the elongated groove.

3. The torsion adjustment structure of claim 1, wherein the abutting member presses against the front groove of the switch member when the switch member is located at the rear end of the elongated groove.

4. The torsion adjustment structure of claim 1, wherein the switch member is disposed adjacent to a top end or a bottom end of the head.

5. The torsion adjustment structure of claim 1, wherein the locations of the receiving groove, the ratchet portion, and the switch member are designed corresponding to one another.

* * * * *